United States Patent [19]

Stokes et al.

[11] 4,295,352

[45] Oct. 20, 1981

[54] DIE FOR THE FORMATION OF SEMI-CLOSED CHANNELS OR OTHER COMPLEX CONFIGURATIONS

[75] Inventors: Richard P. Stokes; William Stokes, both of Carteret, N.J.

[73] Assignee: Unlimited Steel Fabricators, Inc., Middlesex, N.J.

[21] Appl. No.: 84,179

[22] Filed: Oct. 12, 1979

[51] Int. Cl.[3] ..... B21D 22/10

[52] U.S. Cl. ..... 72/57; 72/465

[58] Field of Search ..... 72/57, 465, DIG. 14

[56] References Cited

U.S. PATENT DOCUMENTS

| | | | |
|---|---|---|---|
| 906,911 | 12/1908 | McCullough | 72/57 |
| 2,783,727 | 3/1957 | Hoffmann | 72/57 |
| 3,121,944 | 2/1964 | Karau | 72/465 X |
| 3,705,512 | 12/1972 | Koschatzky | 72/57 |

*Primary Examiner*—Robert C. Watson
*Attorney, Agent, or Firm*—James J. Romano, Jr.

[57] ABSTRACT

A die for the formation of semi-closed channels or other complex configurations comprises a male die member and a female die member. The male die member includes a generally circular mandrel, and elastic, workpiece-retaining pressure means; while the female die member includes an elastically deformable matrix having an open, generally U-shaped forming groove in the upper surface thereof. In operation, the workpiece is driven by the mandrel into the forming groove, and the matrix elastically deformed by matrix deforming apparatus to substantially close the forming groove and wrap the workpiece around the mandrel to form the desired channel. The pressure device retains the workpiece in place during forming while allowing sliding movement of the workpiece to prevent damage to the latter. Following channel formation, the mandrel is withdrawn from the forming groove and the matrix returns to its un-deformed position to re-open the forming groove and enable the ready removal of the workpiece from the die.

8 Claims, 4 Drawing Figures

DIE FOR THE FORMATION OF SEMI-CLOSED CHANNELS OR OTHER COMPLEX CONFIGURATIONS

BACKGROUND OF THE INVENTION

1. Field of the Invention

This invention relates to a new and improved die for the formation of semi-closed channels or other complex configurations in workpieces.

2. Description of the Prior Art

Although dies for the formation of semi-closed channels or other complex configurations in workpieces are known, the same will generally be found to be of relatively complex and expensive design and construction in requiring specialized materials, large numbers of parts, and/or extensive tooling in the fabrication thereof. In addition, many of the prior art dies of this nature will be found lacking in terms of long term reliability in that the same are prone to wear and/or mechanical break-down with resultant high maintenance requirements and attendant frequent periods of totally unproductive down-time. In addition, it is not believed uncommon with regard to many of the prior art dies of this nature to find that, although the same are basically equal to the described task, stretching, surface marring and/or like disadvantageous degradation of the physical properties of the workpiece, and/or bending of the areas of the workpiece adjacent to the configuration of interest, often occur attendant the formation of the latter with the necessity, in many instances, of high rejection rates of the finished products; it being understood by those skilled in this art that this problem would be particularly acute in those instances wherein the workpiece was coated with a material having substantially less resistance to scarring and/or abrasion than the workpiece itself. Also of significant disadvantage with regard to some of the prior art dies of this nature is the fact that the operation thereof is complex and time-consuming, and thus overly costly, in requiring a relatively high level of skill and/or a number of separate steps to achieve the desired end.

OBJECTS OF THE INVENTION

It is, accordingly, an object of our invention to provide a new and improved die for the formation of semi-closed channels or other complex configurations in workpieces which is of simple and inexpensive design and construction.

Another object of our invention is the provision of a die as above which requires the use of only readily available materials of proven dependability in the fabrication thereof to further provide for low cost, and to insure long periods of satisfactory, maintenance-free operation.

Another object of our invention is the provision of a die as above which advantageously functions to form the desired complex configurations in workpieces without any stretching, marring of the surface or surface coating as the case may be, or like degredation in the physical characteristics of the workpiece, and without bending of the adjacent areas of the workpiece.

A further object of our invention is the provision of a die as above which is simple and quick to operate to thus enable advantageously high production rates by relatively unskilled workers, all to significant economic benefit.

A still further object of our invention is the provision of a die as above which, when maintenance is required, can be substantially rebuilt to generally "new" condition by the expedient replacement of a small number of easily pre-fabricated components of a readily available inexpensive material.

DESCRIPTION OF THE DRAWINGS

The above and other objects and advantages of our invention are believed made clear by the following detailed description thereof taken in conjunction with the accompanying drawings wherein.

DETAILED DESCRIPTION OF THE INVENTION

Figure 1:
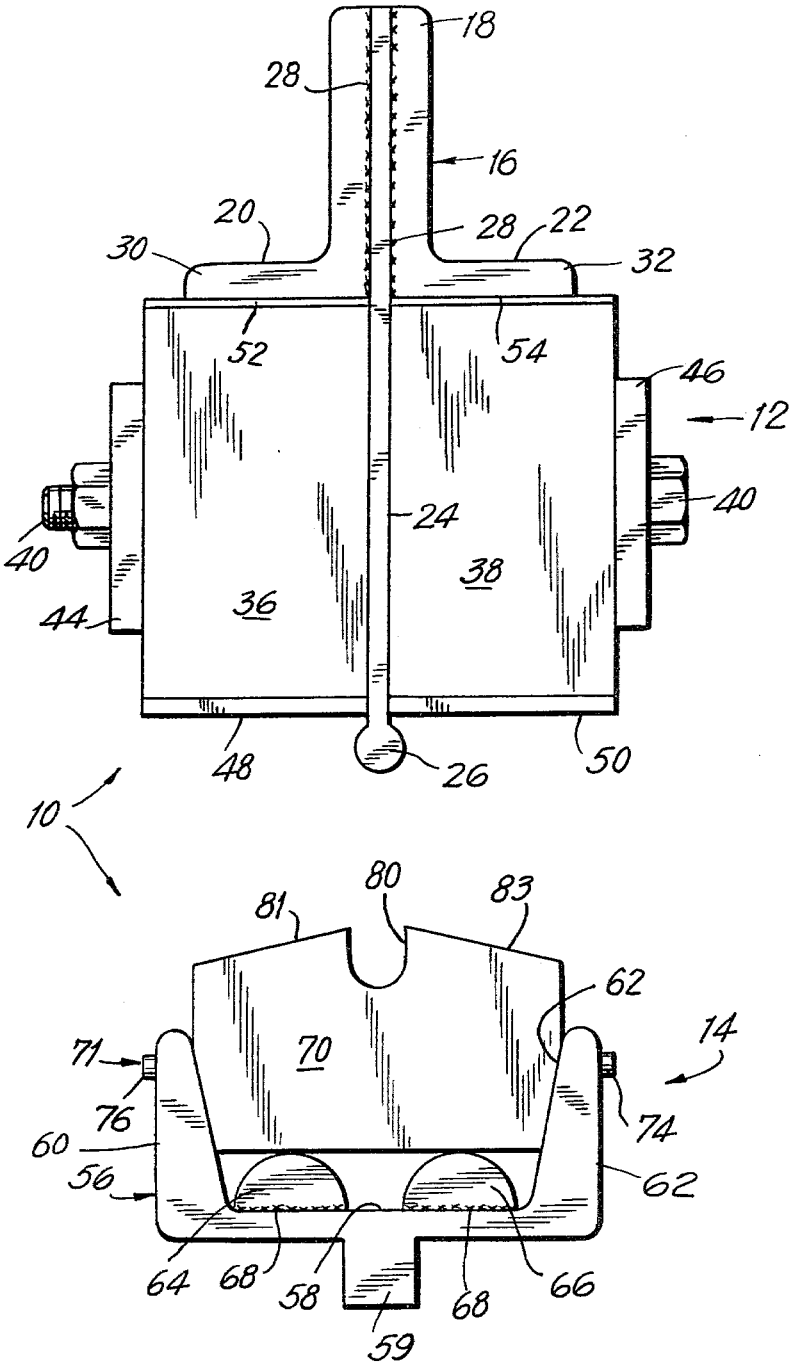
FIG. 1 is an end elevational view of the components of a new and improved die constructed and operative in accordance with the teachings of our invention and shown in the open position thereof.
Figure 2:
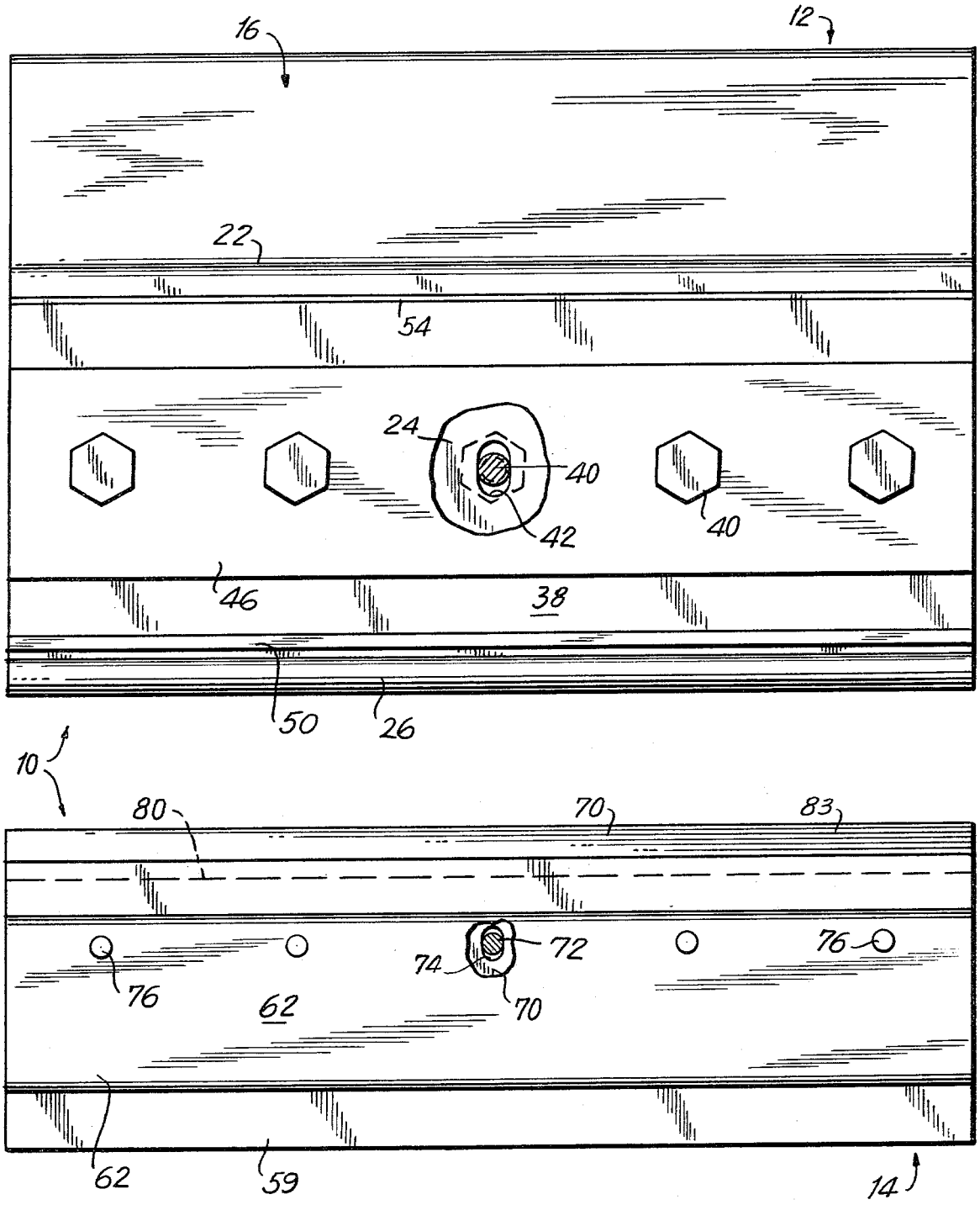
FIG. 2 is a side elevational view of the die components of FIG. 1, again in the open position thereof, and includes a portion broken away for purposes of illustration.

Referring now to FIGS. 1 and 2 of the drawings, a new and improved die constructed and operative in accordance with the teachings of our invention for the formation of semi-closed channels or other complex configurations in workpieces is indicated generally at 10; and will be seen to comprise a male die member as indicated generally at 12, and a female die member as indicated generally at 14.

The male die member 12 comprises a generally cross-shaped support member assembly 16 which includes a mounting tang 18, cross-pieces 20 and 22, and neck 24 which terminates as shown in a generally cylindrical or rod-like mandrel 26 which is laterally coextensive therewith. Preferably, the support member assembly 16 is, for example, of mild steel construction, and is fabricated by the appropriate welding, as indicated at 28, of angles 30 and 32 to the neck 24 to form the mounting tang 18 and the cross-pieces 20 and 22; and the appropriate welding, as indicated at 34, of the mandrel 26 to the neck 24; all to result in a functionally integral, inexpensive, and particularly strong support member assembly.

Further included in the male die member 12 are pressure blocks 36 and 38 which are formed of a readily availble, inexpensive and particularly durable elastic material having appropriate characteristics with regard to compressibility and resiliency for purposes described in greater detail hereinbelow; it being noted, for example, that urethane has proven eminently satisfactory in this regard. Side plates are indicated at 44 and 46; and the side plates and pressure blocks are attached to the neck 24 by spaced through-bolt assemblies 40 which extend as shown through generally oblong apertures 42 formed in the neck 24 as seen in the cut away portion of FIG. 2, and through aligned apertures (not shown) formed respectively in the pressure blocks and side plates. The side plates 44 and 46 are disposed as shown to the outsides of the pressure blocks 36 and 38 and are pressed forcefully thereagainst by the tightening of the through-bolt assemblies 40 as should be obvious, to thus retain the pressure blocks somewhat laterally compressed therebetween. As a result, limited sliding movement of the pressure blocks relative to the neck is permitted. Shims as indicated at 52 and 54 may be disposed between the undersides of the cross pieces 20 and 22 and the upper surfaces of the pressure blocks for purposes described in detail hereinbelow.

Low friction pressure plates are indicated at 48 and 50 and are attached as shown to the respective underside of the pressure blocks 36 and 38 in any suitable manner as, for example, through use of an appropriate adhesive. The pressure plates 48 and 50 are formed of any readily available, appropriately durable inexpensive material of low surface adherence and/or friction characteristics, it being noted, for example, that Teflon has proven particularly satisfactory in this regard.

Referring now to the female die member 14, the same will be seen to comprise a channel-shaped nest member or housing 56 which includes a bottom wall 58 and side walls 60 and 62 extending upwardly therefrom as shown. The housing 56 is preferably made, for example, from mild steel or like material of high strength and durability characteristics; and further comprises matrix deforming means taking the form of spaced half-rounds 64 and 66 which are attached to the bottom wall 58 in any convenient manner, as by welding as indicated at 68, to extend upwardly therefrom as shown. A mounting tang 59 extends downwardly as shown from the housing bottom wall 58 and is coextensive with the latter.

A generally wedge-shaped matrix is indicated at 70 and is preferably made from the same durable, elastic material as the pressure blocks 36 and 38 again, for example, urethane.

Matrix retaining means are indicated generally at 71 and take the form of spaced lengths 72 of a tightly wound spring or like material which extend as seen in the cut-away portion of FIG. 2 through generally oblong apertures 74 formed in the matrix 70 and through aligned apertures (not shown) formed in the housing side walls 60 and 62, and which are secured to the latter by end caps or like fastening means 76 and 78; it being understood that the primary function of the matrix retaining means is to prevent the matrix 70 from being lifted out of the housing 56, while not interfering with the basic function of the matrix as described in detail hereinbelow.

Further included in the matrix 70 is a generally U-shaped forming groove 80 which is complementally sized with regard to mandrel 26, and which extends as shown in FIGS. 1 and 2 generally centrally and laterally of the matrix, and which is coextensive therewith. The upper surfaces 81 and 83 of the matrix taper away downwardly as shown from the forming groove 80.

Figure 3:
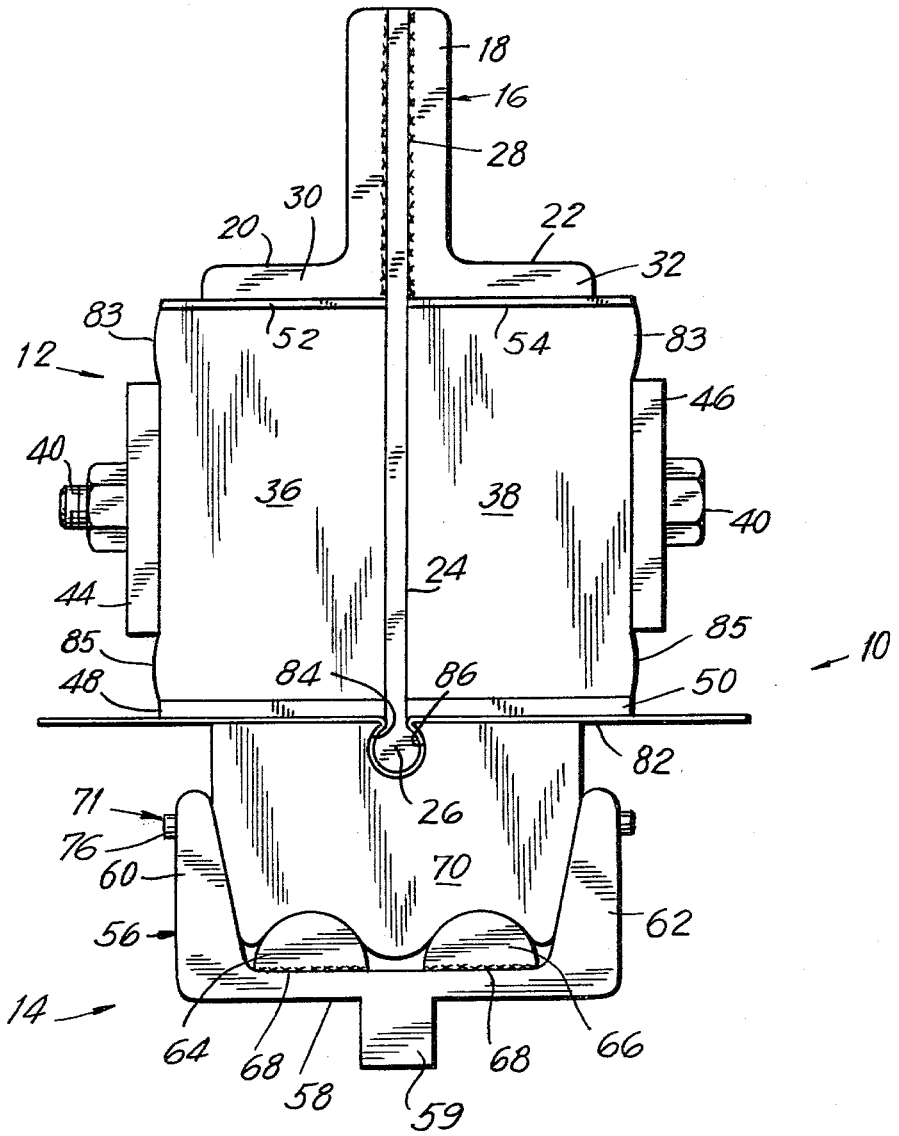
FIG. 3 is an end elevational view of the die components of FIG. 1 shown in the closed position thereof and includes the illustration of a workpiece operatively disposed therebetween.

In operation, as for example in the formation of a semi-closed, generally circular channel in a workpiece of a bendable, generally flat sheet material in the nature, for example, of copper, it may be understood that talc or like readily available, inexpensive material would be dusted on the exposed upper surfaces of matrix 70 to prevent the workpiece, as indicated at 82 in FIG. 3, from sticking thereto. The workpiece 82 would then be positioned atop the female die member 14 with the respective male and female die members in the open position thereof of FIGS. 1 and 2. For use, and although not shown, it will be readily understood by those skilled in this art that the respective male and female die members 12 and 14 would, of course, be operatively mounted, through use of mounting tangs 26 and 59, in an appropriate die operating mechanism in the nature, for example, of a press brake or like device.

With the respective die members 12 and 14 and workpiece 82 positioned as described directly hereinabove, it may be understood that closure of the die 10 to the position thereof depicted in FIG. 3 will result in the relevant portion of the workpiece 82 being forced by the downward movement of the mandrel 26 into the forming groove 80 in the matrix 70, with attendant application of substantial, downwardly directed forces by the mandrel 26, through workpiece 82 on the bottom of forming groove 80, and thus on the upper central portion of the matrix 70. These substantial forces, taken in conjunction with the substantial downward forces applied by pressure plates 48 and 50, again through workpiece 82, to the upper surfaces of the matrix 70 immediately adjacent the forming groove 80, with resultant compression of the pressure blocks 36 and 38 and limited upward movement of the pressure plates 48 and 50 along neck 24 away from mandrel 26 due to the equal and opposite reactive forces, and taken in conjunction with the upwardly directed reactive forces from the half-rounds 64 and 66 on the outer bottom portions of the matrix 70, will result in the compression and elastic deformation of the latter generally to the position thereof depicted in FIG. 3; wherein may readily be seen that the forming groove 80 has in essence been substantially closed around the mandrel 26 to the maximum extent permitted by the relevant thicknesses of the workpiece 82 and the interposed extremity of the neck 24. Limited compression of the pressure blocks 36 and 38 will occur upon closure of the die as described, and this may be relieved in part by slight bulging of the pressure blocks above and below the side plates 44 and 46 as indicated at 83 and 85 in FIG. 3.

This substantial closure as described of the forming groove 80 around mandrel 26 will, of course, result in the effective and extremely tight wrapping of the workpiece 82 around the mandrel 26 to form the desired, semi-closed and generally circular channel in the latter; it being noted that no stretching or surface marring or like disadvantageous degradation of the workpiece 82 is here involved in that the basic non-adherent and low friction surface characteristics of the pressure plates 48 and 50 taken in conjunction with the like characteristics of the talc dusted on the workpiece-retaining surfaces of the matrix 70, will enable the pressure plates to appropriately load down and maintain the relevant portions of workpiece 82 flat and in proper position while nonetheless permitting sliding movement of the same toward the mandrel 26 to the extent required to enable the wrapping as described of the workpiece around the mandrel. This would, of course, be of particularly significant advantage in instances wherein the workpiece 82 was surface-coated with a material, for example, a surface coating to improve solar heat absorption, which is relatively easily scratched or otherwise degraded.

Figure 4:
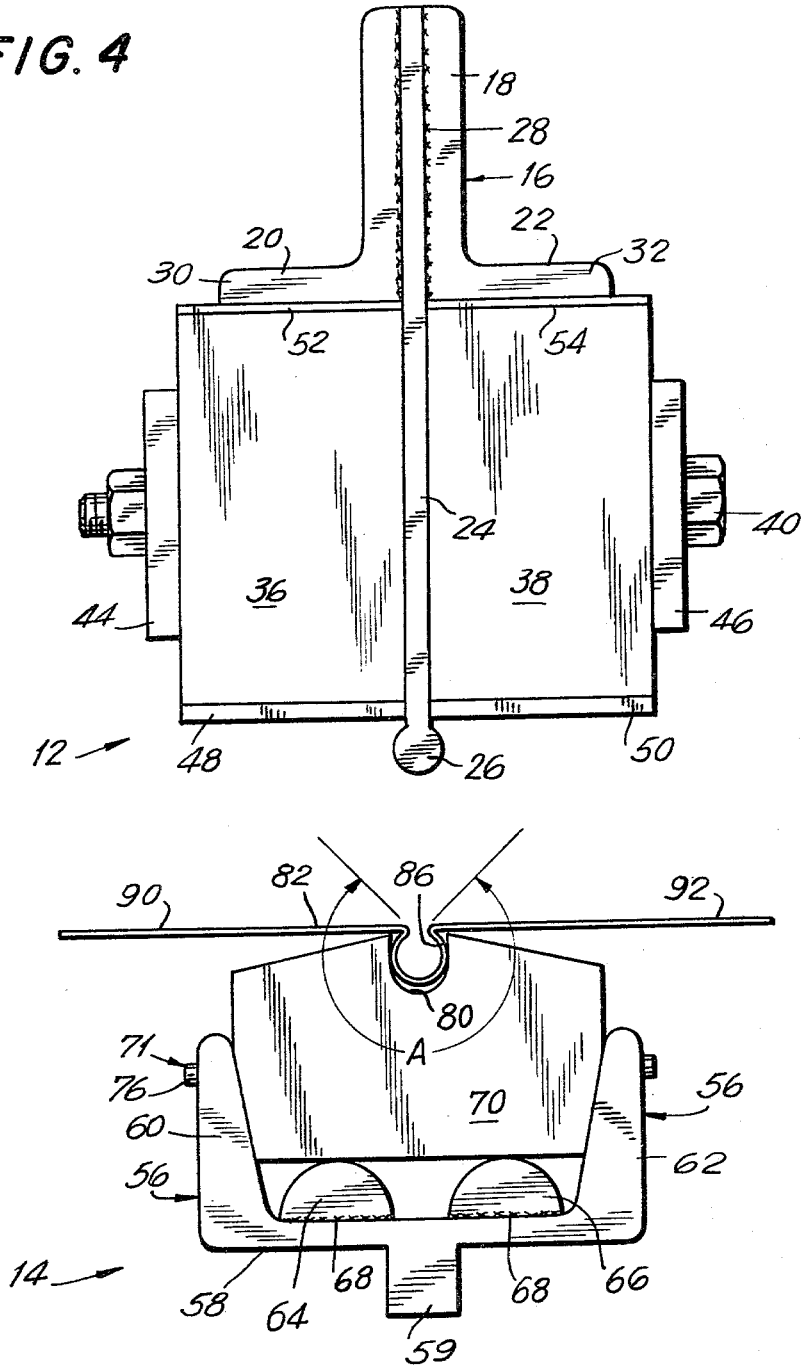
FIG. 4 is a view in the nature of FIG. 3 with the die components in the open position thereof and the now appropriately formed workpiece ready for convenient removal from the die.

Following the above, the respective male and female die members 12 and 14 are simply returned to the open position thereof, with attendant immediate return of the matrix 70 to its original configuration, all to result in an "open" die with the workpiece 82 disposed as shown in FIG. 4 atop the matrix 70, and the now duly formed, semi-closed generally circular channel 86 remaining disposed as shown within the now "reopened" forming groove 80; it being noted that any tendency of the matrix 70 and/or the workpiece 82 to move upwardly with the mandrel 26 upon opening of the die 10 will be resisted by the matrix retaining means 71 as should be obvious. Simple removal of the workpiece 82 and replacement by a "new" workpiece, or repositioning of the workpiece 82 relative to female die member 14 to form a like channel in a different part thereof, can, of course, be followed by immediate recycling of the die as described. Of additional particularly significant advantage in the latter instance is the fact that no bending of the areas of the workpiece 82, as indicated at 90 and 92 in FIG. 4, adjacent the channel 86 will occur attendant formation of the channel, whereby will be readily understood by those skilled in this art that the formation of a plurality of the channels 86 at spaced locations on the same essentially flat workpiece may be readily effected as described through use of the die of our invention with substantial maintenance of the essential flatness of the workpiece.

Convenient and accurate adjustment, within an admittedly somewhat limited range, of the amount of pressure exerted by the pressure plates 48 and 50 upon the workpiece 82 upon full downward travel of the mandrel 26, is made possible, if desired, by the interposition of shims 52 and 54 (FIG. 1) between the pressure blocks 36 and 38 and the cross-pieces 20 and 22; it being believed clear that the greater the thickness of these shims, the greater the pressure that will be expected by the pressure plates on the workpiece.

By way of illustration of the capability of the die of our invention, and not by way of limitation, it is noted that semi-closed, generally circular channels having an angle A as seen in FIG. 4 of at least 270° are routinely successfully formed by the die 10 without damage of any discernible nature to the workpiece 86.

Maintenance of the new and improved die of our invention should obviously be limited to the periodic replacement, at long term intervals, of the pressure blocks 36 and 38, including the pressure plates 48 and 50; and/or the periodic replacement, again at long term intervals, of the matrix 70. Such maintenance is, in either event, particularly simple as should be obvious with, for example, the replacement of the matrix 70 requiring only the sliding of the "old" matrix out of housing 56 and the sliding of the "new" matrix thereinto.

By all of the above is believed made clear that a particularly simple, inexpensive, reliable, effective and economically operable die of the nature described has been provided by the teachings of our invention.

Although disclosed in a preferred embodiment as applicable to the formation of semi-closed, generally circular channels, it will be readily understood by those skilled in this art that the die of our invention is by no means limited to the formation of that specific configuration.

Various changes may, of course, be made in the hereindisclosed preferred embodiment of our invention without departing from the spirit and scope thereof as defined in the appended claims.

What we claim is:

1. In a die for the formation of semi-closed channels or other complex configurations in workpieces which includes relatively movable male and female die members and wherein said male die member includes a mandrel, the improvements comprising, an elastically deformable matrix included in said female die member, said matrix having a surface comprising a generally open forming groove formed therein and configured to receive said mandrel whereby, a workpiece may be disposed between said male and female die members and the same relatively moved to drive said mandrel and the relevant portion of said workpiece into said forming groove to deform said matrix and substantially close said forming groove around said mandrel to essential wrap said workpiece portion around said mandrel and form said configuration therein, whereupon said male and female die members may be relatively moved to remove said mandrel from said forming groove with attendant return of the matrix to its undeformed condition and re-opening of said forming groove to enable removal of said workpiece portion therefrom, said matrix being generally wedge-shaped, and said forming groove being formed in the wider surface of the matrix which tapers away to either side of said forming groove.

2. In a die for the formation of semi-closed channels or other complex configurations in workpieces which includes relatively movable male and female die members and wherein said male die member includes a mandrel, the improvements comprising, an elastically deformable matrix included in said female die member, said matrix having a surface comprising a generally open forming groove formed therein and configured to receive said mandrel whereby, a workpiece may be disposed between said male and female die members and the same relatively moved to drive said mandrel and the relevant portion of said workpiece into said forming groove to deform said matrix and substantially close said forming groove around said mandrel and form said configuration therein, whereupon said male and female die members may be relatively moved to remove said mandrel from said forming groove with attendant return of the matrix to its undeformed condition and re-opening of said foring groove to enable removal of said workpiece portion therefrom, said die further comprising, matrix deforming means included in said female die member and operable to deform said matrix upon the driving of the mandrel into said forming groove, said matrix deformation means comprising matrix support means which extend into contact at spaced locations on the surface of said matrix opposite the matrix surface in which said forming groove is formed.

3. In a die for the formation of semi-closed channels or other complex configuration in workpieces which includes relatively movable male and female die members and wherein said male die member includes a mandrel, the improvements comprising, an elastically deformable matrix included in said female die member, said matrix having a surface comprising a generally open forming groove formed therein and configured to receive said mandrel whereby, a workpiece may be disposed between said male and female die members and the same relatively moved to drive said mandrel and the relevant portion of said workpiece into said forming groove to deform said matrix and substantially close said forming groove around said mandrel to essentially wrap said workpiece portion around said mandrel and form said configuration therin, whereupon said male and female die members may be relatively moved to remove said mandrel from said forming groove with attendant return of the matrix to its undeformed condition and re-opening of said forming groove to enable removal of said workpiece portion therefrom, said die further comprising, elastic, workpiece-retaining pressure means included in said male die member and operable to press the workpiece against said matrix surface outside of said forming groove atendant the driving of said mandrel into said forming groove and deformation of said matrix, while enabling sliding movement of the workpiece toward said forming groove to prevent damage to the workpiece.

4. In a die as in claim 3 wherein, said matrix is made of urethane.

5. In a die as in claim 3 wherein, said elastic, workpiece-retaining means are made of urethane.

6. In a die as in claim 3 further comprising, friction reduction means operatively associated with said workpiece-retaining pressure means and with said matrix surface and operable to press the workpiece therebetween while enabling sliding movement of the latter.

7. In a die as in claim 6 wherein, said friction reduction means comprise, pressure plate means of a mandrel having low surface friction characteristics operatively associated with said workpiece-retaining pressure means, and a material of low surface friction characteristics on said matrix surface.

8. In a die as in claim 7 wherein, said material is talc.

* * * * *